United States Patent [19]

Davis

[11] 4,067,153

[45] Jan. 10, 1978

[54] DOME STRUCTURE

[76] Inventor: Richard Phillip Davis, P.O. Box 881, San Diego, Calif. 92112

[21] Appl. No.: 609,031

[22] Filed: Aug. 29, 1975

[51] Int. Cl.[2] ..... E04B 7/32

[52] U.S. Cl. ..... 52/80; 52/236.2; 52/406

[58] Field of Search ..... 52/80, 82, 81, 187, 52/86, 237, 87, 406, 236.2; 292/265

[56] References Cited

U.S. PATENT DOCUMENTS

| | | | |
|---|---|---|---|
| 625,258 | 5/1899 | Grow | 52/80 |
| 1,099,599 | 6/1914 | Hartnell | 52/80 |
| 1,745,588 | 2/1930 | Shodron | 52/86 |
| 1,836,611 | 12/1931 | Meyer | 292/265 X |
| 2,775,794 | 1/1957 | Keely | 52/82 |
| 2,879,553 | 3/1959 | Keating | 53/80X |
| 3,016,316 | 1/1962 | Olson | 52/593 |
| 3,380,203 | 4/1968 | Peterschmidt | 52/81 |
| 3,417,520 | 12/1968 | Fink | 52/80 |
| 3,802,132 | 4/1974 | Sumner | 52/80 |
| 3,877,186 | 4/1975 | Cartier | 52/82 |

FOREIGN PATENT DOCUMENTS

| | | | |
|---|---|---|---|
| 254,105 | 5/1963 | Australia | 52/237 |
| 292,650 | 9/1967 | Australia | 52/81 |
| 139,287 | 5/1934 | Austria | 52/80 |
| 47,414 | 11/1939 | Netherlands | 52/580 |
| 24,445 of | 1895 | United Kingdom | 52/237 |

OTHER PUBLICATIONS

"Field House," Architectural Record, May 1936, pp. 372, 373.

*Primary Examiner*—Leslie Braun
*Attorney, Agent, or Firm*—Ralph S. Branscomb

[57] ABSTRACT

A simple and attractive dome structure comprises a pair of orthogonally intersecting arcuate main beams which define a portion of a sphere and a plurality of arcuate ribs lying in vertical planes are spaced between the ribs and supported by horizontal circular floor joists which are mounted interiorly of the beams and ribs. The structure is enclosed by wall segments one of which is disposed between each adjacent rib pair, these segments comprising a double layer of slats which are inserted into channels in the ribs and sandwich a layer of insulation therebetween. The ribs, joists, and main beams are of laminar wood construction, and a pair of annular floors are supported at their perimeters by the previously mentioned circular joists and centrally by circular joists suspended by cables from the main beams, there being a helical staircase providing central access to the annular floors from the supporting surface below the structure.

6 Claims, 5 Drawing Figures

DOME STRUCTURE

BACKGROUND OF THE INVENTION

A number of dome structures have been designed for various purposes, many of which were inspired by the geodesic dome and concepts of organic architecture. Many of these structures are quite elaborate, and some are very practical, but there is a need for a dome of simple symmetry and aesthetic appeal having the characteristics of strength and heat-containing ability necessary in a dwelling unit.

SUMMARY OF THE INVENTION

The present invention fulfills the above recognized need and comprises a dome of generally spherical symmetry having insulated double walled construction, the sole ground support for the main structure being a pair of intersecting beams of circular arc configuration having ends which rest on the ground and which lie in vertical orthogonal planes. Arcuate ribs are spaced between these main beams and conform to the spherical shape of the structure, the ribs being of laminar wooden construction and including two component members of the laminate which are of narrower width than adjacent members so that each side of the ribs has two longitudinal channels therein, and in these channels are seated horizontal laths or slats interrupted by windows to form arcuate wedge-shaped wall elements between the ribs.

Two horizontal circular joists, also of laminary construction are bolted interiorly of the sphere to the beams and ribs, serving both to stabilize the vertical structural elements and to support two annular floors. The inner circumferences of the annular floors are supported on circular joists suspended by the cables from overlying portions of the main beams, and a helical staircase provides access from the ground level to both floors. Radial joists extending between the inner and outer circular joists provide further support for the floor boards to give the floor support structure a wagon wheel effect.

DETAILED DESCRIPTION OF THE PREFERRED EMBODIMENT

Figure 1:
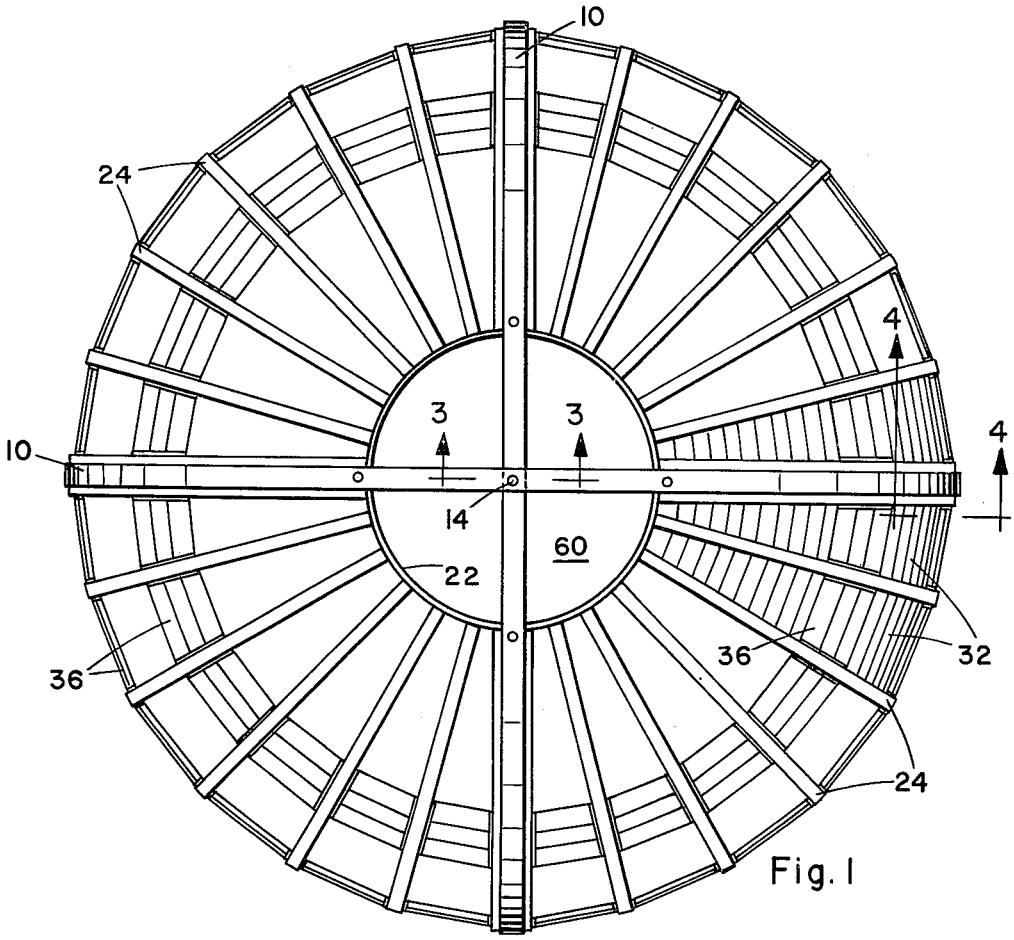
FIG. 1 is a top plan view of the building.
Figure 2:
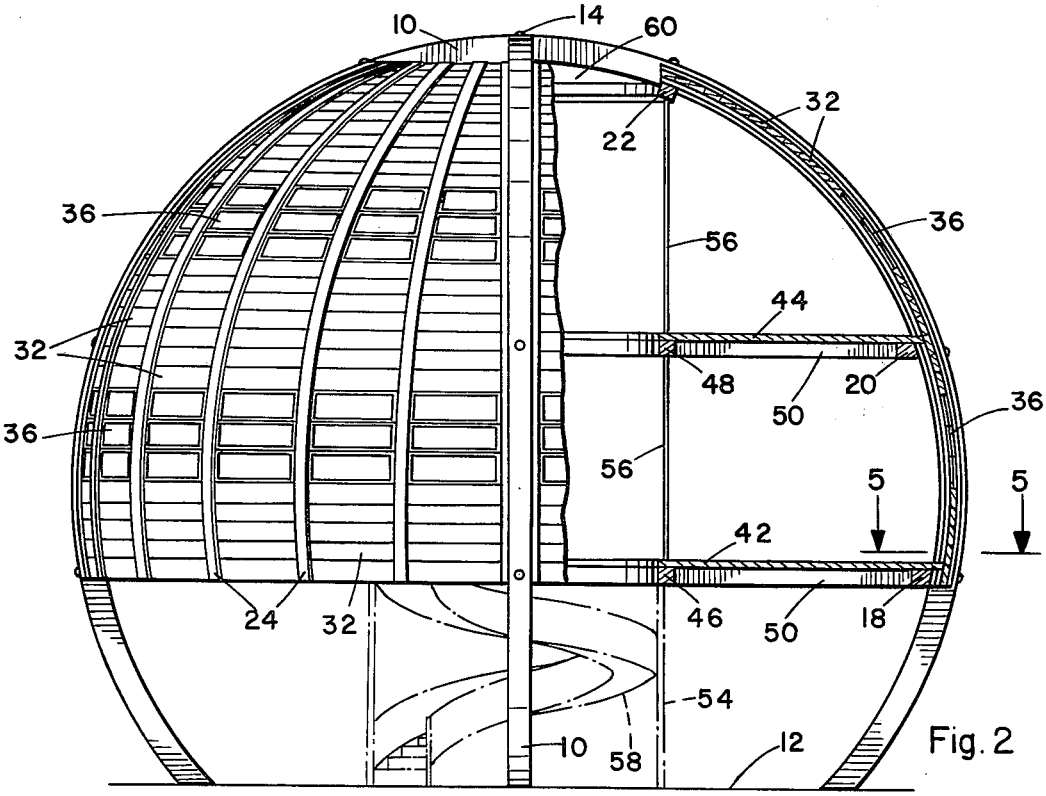
FIG. 2 is a side elevation view, partially cut away.

The dome structure is a portion of a sphere, as can be seen from FIGS. 1 and 2, the principal support being configured as portions of circular arcs. As seen in FIG. 2, the illustrated structure represents about three quarters of a complete sphere, although a complete sphere could be used, or a portion thereof much smaller than that illustrated. Conceivably a complete sphere could be rotatably mounted to follow the sun or simply for purposes of a change of view.

Figure 3:
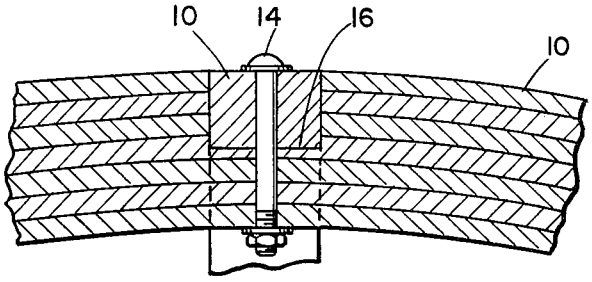
FIG. 3 is an enlarged sectional view taken on line 3—3 of FIG. 1.

The principal supports for the structure are two continuous beams 10 which are notched to interfit at the uppermost extremity, both of these beams lying in a vertical plane and orthogonally intersecting each other, the lowermost ends supporting the structure above a surface 12 which could be a concrete slab or the ground itself. At their meeting place these beams are joined with a long vertical bolt 14 which passes through the notched areas 16 of the beams as detailed in FIG. 3 so that the junction is smooth.

Several horizontal circular supports are bolted to the inside of these beams, two of these, indicated at 18 and 20, doubling as floor joists, and a third being a ring support 22 mounted near the top of the structure. The beams and the circular supports are preferably of laminar wooden construction as are the other curved support members described hereinafter.

Figure 5:
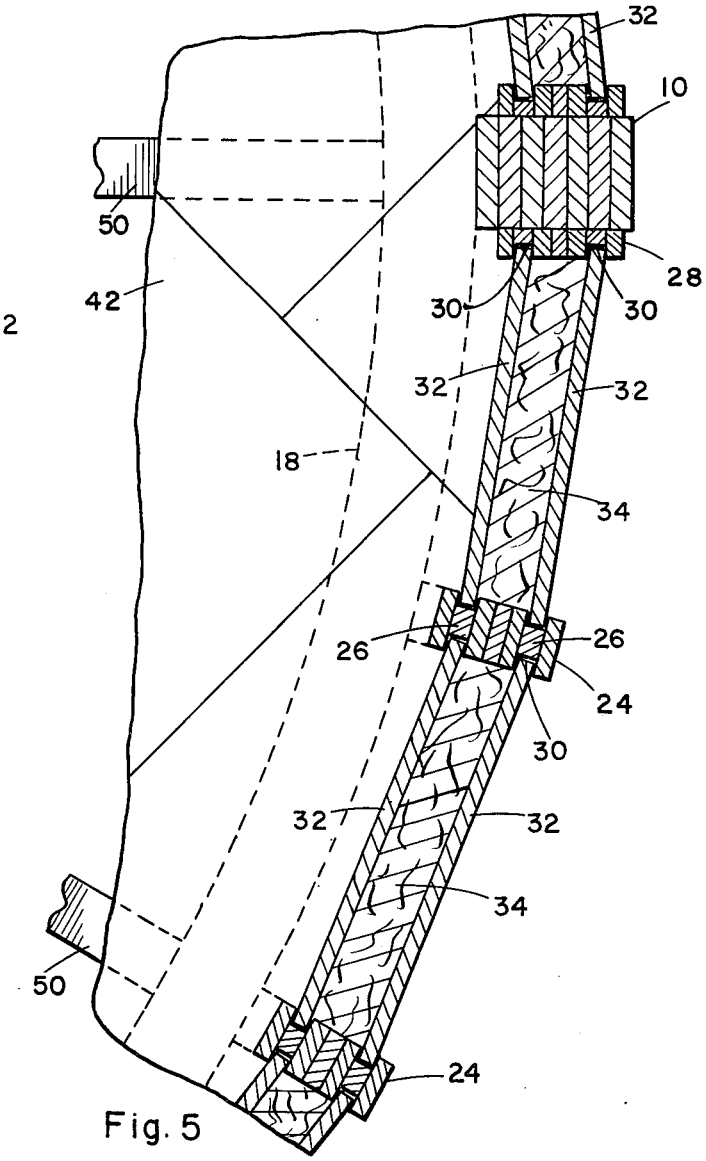
FIG. 5 is an enlarged sectional view taken on line 5—5 of FIG. 2.

At intervals between the generally upright portions of the beams 10 several ribs 24 are mounted, these ribs being circular arcs in keeping with the spherical shape of the structure and are mounted by bolts, glue, or any other suitable means or combination of means to the joists 18 and 20 and the upper ring 22. The ribs are also of laminar construction and comprise several layers of different widths as thus seen in FIG. 5, two of the interior layers, indicated at 26 being narrower than the remaining boards or layers and preferably being separated by about three inches, which is represented in the drawings as three layers inasmuch as one inch thick boards have been chosen for use in the ribs. Although this arrangement could be essentially duplicated in the beam structure, for purposes of manufacturing ease the beams are rectangular in cross section and have mounted to each side thereof the equivalent of half of a rib 28.

Figure 4:
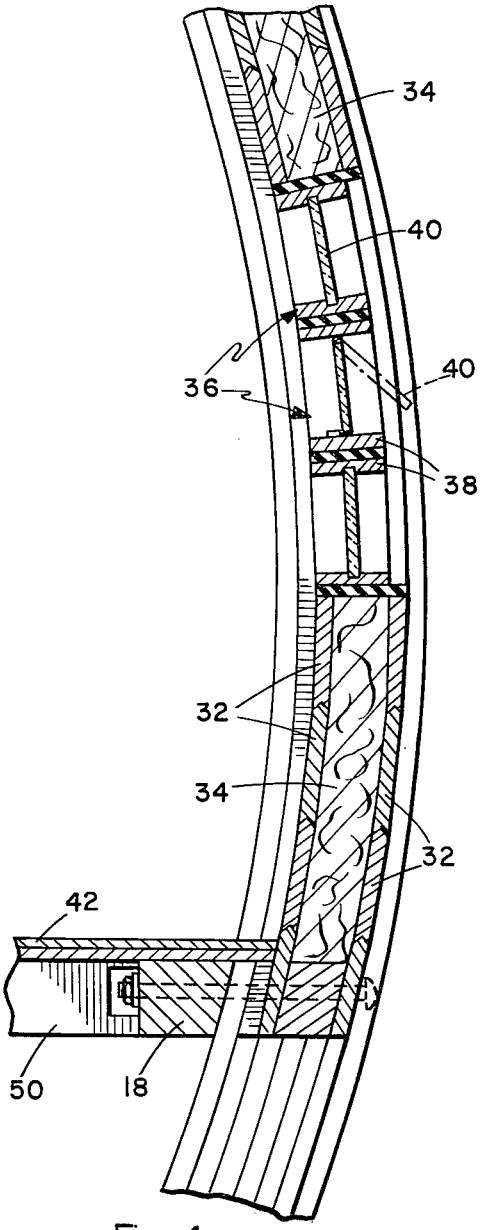
FIG. 4 is an enlarged sectional view taken on line 4—4 of FIG. 1.

After the main beams and ribs have been mounted into position, it can be seen that every pair of adjacent ribs, or every pair consisting of one rib and a half rib mounted to a beam, provides two pairs of opposed channels 30, and into these channel pairs are inserted numerous horizontal slats 32 which must of course be cut at graduated lengths to fit between the varingly spaced ribs. The slats may be pointed at one edge and dovetailed at the other so that they snugly mate together when they are inserted in the channels as shown in FIG. 4. Thus it can be seen that each rib pair frames an arcuate, wedge shaped wall segment comprising a double thickness of slats 32 having a space therebetween in which an insulation material 34 is inserted.

It is prefered that several or all of the wall segments have windows therein, and as is shown in FIGS. 2 and 4, window elements 36 consisting of a rectangular frame member 38 and a transparent pane portion 40 be installed at selected intervals in the channels to interrupt the slated wall segments. The windows would of course have suitable weather sealing means around the pane periphery and would preferably fold outwardly as indicated at FIG. 4 and have means to lock same in the outwardly open position. The inner layer of slats could be formed from scrap wood of any kind, and the outer layer could be similarly constructed with the entire structure aside from the windows being covered by decorative wooden shingles. It would of course also be possible to use a single layer of slats if insulation were not needed or desired, or the slats could be omitted entirely and instead window elements or other transparent panels be used exlusively so that the structure would have a green house effect. Other variations within the basic framework of the rib and channel construction concept will become apparent are within the scope of the invention.

Within the rib and wall structure just described are a pair of spaced annular floors 42 and 44 which are supported at their inner circumferences by a pair of inner circular joists 46 and 48, and between each pair of inner and outer circular joists are mounted a plurality of radially extending straight joists 50 so that the beam or joist structure supporting each floor has an attractive wagon wheel appearance from beneath. As illustrated in FIG. 2, the lower floor 42 is supported by pillars 54 from the ground, and both floors are also supported by four cables 56 which are suspended from the four points of intersection of the upper ring 22 and its support beams 10. The floors 42 and 44 could be constructed of any suitable flooring material such as the 4 foot × 8 foot plywood boards illustrated in FIG. 5, and of course any additional understructure necessary to support the flooring could be added. Clearly only one floor could be provided, or more than two, but for the purposes of having at least one floor which maximizes room and head space it is desirable that, in the case of a structure which comprises more than half of a sphere, one of the floors such as floor 44 in the drawings, be mounted somewhat below the widest point in the structure since at other levels either head room or foot room is sacrificed due to the curvature of the walls. For purposes of aesthetics and to eliminate floor area, which is undesirable due to limited headroom, the upper story could be terminated short of the surrounding wall and railed off, and the inner margin would be similarly provided with a rail.

It should also be noted that the wall structure in the illustrated embodiment extends downwardly only to the lower floor 42 so that a large open space which could be used for a patio and garage, for example, exists below the building. Access to the floors from the ground level is achieved by a helical staircase which may also be suspended at least in part from the cables 56. In the building as described thusfar there remains a circular open space 60 at the top of the structure which would be covered by a sky light, crows nest, or a pyramid-shaped superstructure to entirely enclose the building.

The structure when completed as described above provides an aesthetic and organic building of natural wood construction, being easily constructed either on site or partially in a factory by the use of circular jigs into which the boards for the laminate can be placed, glued, and cinched tight to dry, there being very few angles to be cut or irregularly shaped members to be delt with. The double thickness insulated wall structure makes the dome ideal for use as a mountain cabin which could vary in size from a very small, one story building to a much larger structure having several stories. Ventalation can be achieved by ducts around 60 and around and adjacent to rings 18 and 20.

I claim:

1. A dome structure comprising:

a. a pair of main support beams each describing a substantially circular arc and lying in a vertical plane with the ends thereof seated on a supporting surface;

b. said beams orthogonally intersecting each other at their uppermost extremity to define a portion of a sphere;

c. a plurality of secondary ribs, each defining a substantially circular arc;

d. means supporting said ribs in angularly spaced relation between said beams and in the spherical surface define thereby;

e. each of said ribs having a pair of elongated channels, one in each side thereof such that each pair of adjacent ribs defines a pair of facing channels; which are arcuate essentially in the direction of a great circle defined by the channel defining ribs;

f. a multiplicity of laterally extended slats seated in said facing channel pairs and, said slats being vertically contiguous to define a substantially continuous wall segment between each pair of adjacent ribs and being substantially planar and of width and height dimensions to seat at least roughly within said arcuate facing channel pairs despite being planar;

g. an annular floor supported by two coplanar circular joists disposed beneath the inner and outer circumference thereof respectively; and h. said circular joists being suspended by cables from overlying portions of said beams and including a plurality of radial joists extending between said inner and outer circular joists, and the outer of said joists being mounted to said beams.

2. Structure according to claim 1 wherein said floor is spaced above the surface upon which said beams rest and said wall segments extend downwardly terminating at the level of said floor whereby an open space is created beneath said floor.

3. Structure according to claim 1 and including a pluraltiy of radial joists extending between said inner and outer joists.

4. Structure according to claim 1 wherein each of said ribs is provided with a pair of parallel channels in each side thereof such that every pair of adjacent ribs defines two pairs of facing —arcuate— slots and including a multiplicity of horizontally extended slats seated in each of said slat pairs to define two generally parallel layers of slats between each pair of adjacent ribs, and further including insulation material disposed between said substantially parallel slat layers whereby said dome structure is double walled and insulated at least in part.

5. Structure according to claim 4 wherein said ribs are of laminar wood construction and said channels are defined by including certain interior members in the laminate having narrower width dimension than adjacent members of the laminate.

6. Structure according to claim 1 and including a plurality of window elements having rectangular frames and being disposed in said slat channels such that a plurality of wall segments are interrupted by windows.

* * * * *